United States Patent [19]

Bourlet

[11] 4,303,015

[45] Dec. 1, 1981

[54] PRE-FRAGMENTED EXPLOSIVE SHELL

[75] Inventor: Maurice V. Bourlet, Liege, Belgium

[73] Assignee: Fabrique Nationale Herstal, en abrége F.N., Herstal, Belgium

[21] Appl. No.: 121,909

[22] Filed: Feb. 15, 1980

[30] Foreign Application Priority Data

Feb. 28, 1979 [BE] Belgium ..... 57634

[51] Int. Cl.[3] ..... F42B 13/48

[52] U.S. Cl. ..... 102/492

[58] Field of Search ..... 102/67, 68

[56] References Cited

U.S. PATENT DOCUMENTS

| | | | |
|---|---|---|---|
| 3,101,053 | 8/1963 | Stevenson et al. | 102/67 X |
| 3,489,088 | 1/1970 | Von Ballmoos et al. | 102/68 X |
| 3,508,493 | 4/1970 | Olenick, Jr. | 102/67 |
| 3,547,032 | 12/1970 | Horvath, Jr. | 102/67 |
| 3,791,818 | 2/1974 | Watmough et al. | 102/67 X |
| 3,880,081 | 4/1975 | Riffin et al. | 102/67 |
| 3,951,068 | 4/1976 | Schroeder | 102/68 X |
| 3,994,752 | 11/1976 | Hayes | 102/67 X |
| 4,023,492 | 5/1977 | Kempton | 102/67 X |

OTHER PUBLICATIONS

*Hackh's Chemical Dictionary,* Fourth Edition, 1972, McGraw-Hill Book Co., pp. 736 & 737.

High Temp. Refractory Metals, Metallurgical Soc. Conf., vol. 34, N.Y., N.Y., Feb. 16-20, 1964, pp. 157-159.

*Primary Examiner*—Peter A. Nelson

*Attorney, Agent, or Firm*—Bacon & Thomas

[57] ABSTRACT

Pre-fragmented explosive shell, of the type substantially comprising a head and a body containing an explosive charge, a plurality of balls being housed in an annular space provided for between at least a part of the wall of the aforesaid body and the aforesaid explosive charge, in which each of the aforesaid balls consists of a core made from tungsten or tungsten carbide coated with a thin layer of zirconium.

2 Claims, 1 Drawing Figure

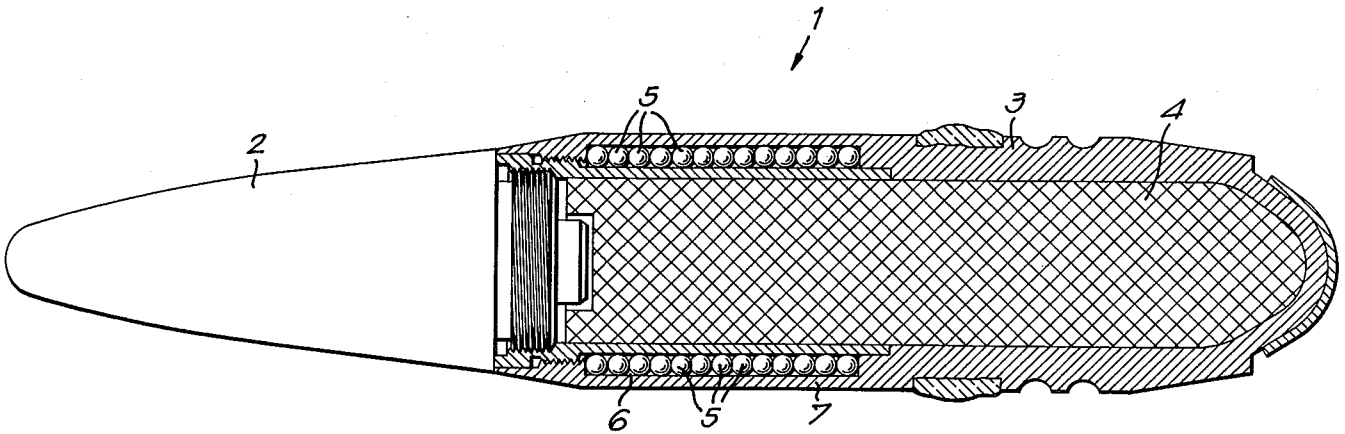
1
2
3
4
5
5
5
6
7

PRE-FRAGMENTED EXPLOSIVE SHELL

BACKGROUND OF THE INVENTION

The present invention relates to a pre-fragmented explosive shell containing a quantity of small balls.

In order to increase the destructive power of the known shells, it has already been proposed to place around at least a part of the explosive charge of a shell a quantity of balls made from a very hard material, for instance tungsten or tungsten carbide, the hardness of which is comparable to the hardness of diamond.

Usually, such a projectile is called a shrapnel. When the shrapnel explodes, the balls are projected in all directions and, in this way, confer to the projectile a great destructive power. The efficiency of a shrapnel depends not only on its explosive charge, but also on the number of balls that it contains and of their capacity of penetrating into the target. For a same target, the penetration of the balls substantially depends on their impact energy and hardness. The impact energy substantially corresponds to the reduced kinetic energy of the energy dissipated when flying, due to the aerodynamic resistance encountered by the balls.

It will be understood that for obtaining a sufficient penetration into the target, the diameter of the balls will be selected taking into account the density of the constituent material and configuration of the explosive charge, so that their impact energy will be as great as possible. It follows that, for a predetermined degree of penetration, the diameter of the balls will be selected pro rata of the parameters quoted hereinabove and accordingly must correspond to an optimal value.

Therefore, the number of balls in the shrapnel is comparatively limited by the dimensions of the balls and, consequently, the probability of a shot into the target is also limited.

SUMMARY OF THE INVENTION

The invention consists in coating the balls made from tungsten or tungsten carbide with a thin layer of zirconium.

It should be noted that it has already been proposed to make single projectiles with a zirconium nose, in order to enhance the capacity of penetration into the target. It is also known that such single projectiles may have an incendiary effect in some circumstances due to the presence of the aforesaid zirconium.

This enhancing of the penetration capacity and incendiary effect are, however, aleatory, because of the fact that they depend on the angle of incidence of the projectile when hitting the objective and on the characteristics of the latter.

On the contrary, the complete coating of the balls according to the invention in a projectile of the type under consideration preserves the incendiary power of same, whichever the angle of impact may be, provided, of course, that there is a penetration into the target, since the rear part of the projectile, a ball in the present case, remains coated with zirconium after penetrating into the target, which is not the case for the aforesaid single projectiles.

In addition to the preceding statement, it should be noted that for the same capacity of penetration the diameter of the balls according to the invention can be much reduced in comparison with the usual balls. It follows that the number of balls in the shrapnel and, consequently, the probability of a hit at the target are considerably increased.

The zirconium coat is preferably applied in the gaseous phase.

BRIEF DESCRIPTION OF THE DRAWINGS

In order to ensure a better understanding of the invention, this will be described more in detail, referring to an example of a practical realization of a shrapnel as shown in the attached drawing.

DESCRIPTION OF A PREFERRED EMBODIMENT

The shrapnel 1 substantially comprises a head 2, for instance a proximity fuse, and a body 3 containing the explosive charge 4. A plurality of balls 5 is housed in an annular space 6, provided for between at least a part of the wall 7 of the body 3 and of the charge 4.

A projectile of this kind is well known.

In order to increase the probability of hitting the target, without, however, making any concession as far as penetration is concerned, the present invention proposes to coat, preferably in gaseous phase, the known balls made from tungsten or tungsten carbide, with a thin coat of zirconium.

The zirconium confers on the balls 5 not only an incendiary effect when they hit a sufficiently thick target, but this effect remains preserved even after penetration into the target. Furthermore, the zirconium considerably enhances the perforating power of the balls through auto-lubrication.

Thus, according to the invention, the diameter of the balls 5 can be considerably reduced in comparison with the diameter of ordinary balls, the capacity of penetration remaining unchanged. Consequently, a greater number of balls 5 can be housed in the annular space 6, so that the probability of hitting a target is considerably increased.

It goes without saying that the inventive idea is not limited to the application described hereinabove as a non-limitative example, but that other applications may be found without going outside the scope of the invention.

I claim:

1. Pre-fragmented explosive shell comprising a head and a body containing an explosive charge, a plurality of balls being housed in an annular space between at least a part of the wall of the body and the explosive charge, in which each of said balls consists of a core made from tungsten or tungsten carbide coated with a thin layer of zirconium.

2. Shell according to claim 1, in which said zirconium layer is applied in gaseous phase.

* * * * *